M7219 XR 4,153,120

United States Patent [19]

Zuvela et al.

[11] 4,153,120

[45] May 8, 1979

[54] CHANGE IN LENGTH OF DRILL STRING WHILE INSTRUMENT REMAINS THEREIN

[75] Inventors: Bernard R. Zuvela; Raymond W. Teys, both of Fountain Valley, Calif.

[73] Assignee: Scientific Drilling Controls, Newport Beach, Calif.

[21] Appl. No.: 838,653

[22] Filed: Oct. 3, 1977

[51] Int. Cl.[2] ..... E21B 7/00

[52] U.S. Cl. ..... 175/57; 175/45; 175/62; 166/65 R

[58] Field of Search ..... 175/65, 104, 105, 40–50, 175/61, 62, 57; 166/65 R; 174/47, 15; 339/16 R, 16 RC; 324/10

[56] References Cited

U.S. PATENT DOCUMENTS

| | | | |
|---|---|---|---|
| 2,232,360 | 2/1941 | Barnett | 174/47 X |
| 2,249,769 | 7/1941 | Leonadon | 324/10 |
| 2,370,818 | 3/1945 | Silverman | 175/50 X |
| 2,706,616 | 4/1955 | Osmun | 175/104 X |
| 3,285,629 | 11/1966 | Cullen et al. | 285/119 |
| 3,825,079 | 7/1974 | Heilhecker | 175/57 |
| 3,913,688 | 10/1975 | Heilhecker et al. | 175/65 X |
| 4,001,774 | 1/1977 | Dawson et al. | 324/10 X |

*Primary Examiner*—Ernest R. Purser
*Assistant Examiner*—Richard E. Favreau
*Attorney, Agent, or Firm*—William P. Green

[57] ABSTRACT

A hole in the earth is formed utilizing a drill string containing an instrument connected by a flexible conductive line to a unit at the surface of the earth. During intervals when the length of the drill string is being changed, as by addition of another pipe section to the outer end of the string, the connection between the flexible line and the surface unit is temporarily broken, so that the instrument and line can be left in the drill string while the section is added and for ultimate reconnection to the surface unit through the added section. A portion of the flexible line may be wound about an element in the string, to be unwound therefrom each time that the string is lengthened, to thereby correspondingly increase the effective length of the line.

25 Claims, 10 Drawing Figures

CHANGE IN LENGTH OF DRILL STRING WHILE INSTRUMENT REMAINS THEREIN

BACKGROUND OF THE INVENTION

This invention relates to improved methods and apparatus for drilling holes in the earth utilizing a drill string containing an instrument which is connected by a flexible line to a read-out unit or other unit at the surface of the earth. The invention will be described primarily as applied to the drilling of generally horizontal holes into the earth, such as are frequently required for degasification of coal seams or the like, but it will be apparent as the description progresses that the invention is also applicable to the drilling of holes in other directions, such as generally vertically or at any selected inclination of slant.

In many drilling situations, it is desirable to monitor or control the drilling operation closely as it progresses, by an instrument which can sense a particular condition or attain a particular result only when the instrument is contained within the drill string. For example, an instrument may be employed which can sense the inclination of the drill string at a certain instant, and also sense the azimuth of that inclination, so that the drillers may then take such steps as are necessary to effect the correction required in order to finally reach a desired point in the earth formation. An instrument capable of functioning in this manner is shown in U.S. Pat. No. 3,791,043. The instrument probe of that patent may be contained in the drill string and connected by a flexible conductive line to a read-out unit at the surface of the earth on which the inclination and azimuth are indicated. An improved probe for such a system is shown in U.S. Pat. No. 3,862,499.

In using such inclination instruments, or other instruments which are connected to surface equipment by a flexible line, it has heretofore been necessary to remove the instrument and flexible line from the drill string each time that the length of the string is changed. This necessitates the expenditure of a substantial amount of time and effort on each such occasion, in first pulling the flexible line and instrument to the surface of the earth before addition or removal of a pipe section and then ultimately reinserting the line and instrument into the wall for further use.

SUMMARY OF THE INVENTION

The present application and my copending application, Ser. No. 838,804, filed of even date herewith disclose and claim unique methods and apparatus which avoid the necessity for removing such an instrument and connecting line from a drill string each time that the length of the string is to be changed, and instead enable the flexible line and instrument to be left essentially in place in the string while a pipe section is being added to (or removed from) the string. In the present invention, this is preferably accomplished by providing detachable connector members at the surface of the earth through which the flexible line is connected to the surface mounted unit, and which are separable to break that connection temporarily while a new pipe section is being connected to or removed from the outer portion of the string, with the connector members ultimately being brought back together to reconnect the flexible line to the surface unit after the length of the drill string has been changed. Desirably, provision is made for increasing the effective length of the flexible line when the drill string is lengthened, by positioning in the drill string an element about which a portion of the flexible line is wound, and from which the line can be partially unwound each time that a pipe section is added, to thereby increase the effective length of the line in correspondence with the extension of the string itself. In a preferred arrangement, this element about which the flexible line is windable is detachably connectable to an outer end section of the drill string by a conductive hook shaped member carried by that section of the string.

Electrical connection to the unit at the surface of the earth may be made by means of a conductor extending through a side wall of the outer end section of the drill string. Also, the electrical connection at the outside of the string may include connector elements which are detachable to break the connection to the unit during intervals when the drill string is being rotated to perform a drilling operation, if a type of drilling is employed in which the entire string turns. The invention is applicable to such rotary drilling, and also to an arrangement in which the drill string does not turn but rather carries a power driven motor and bit at the inner end of the string.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENT

Figure 1:
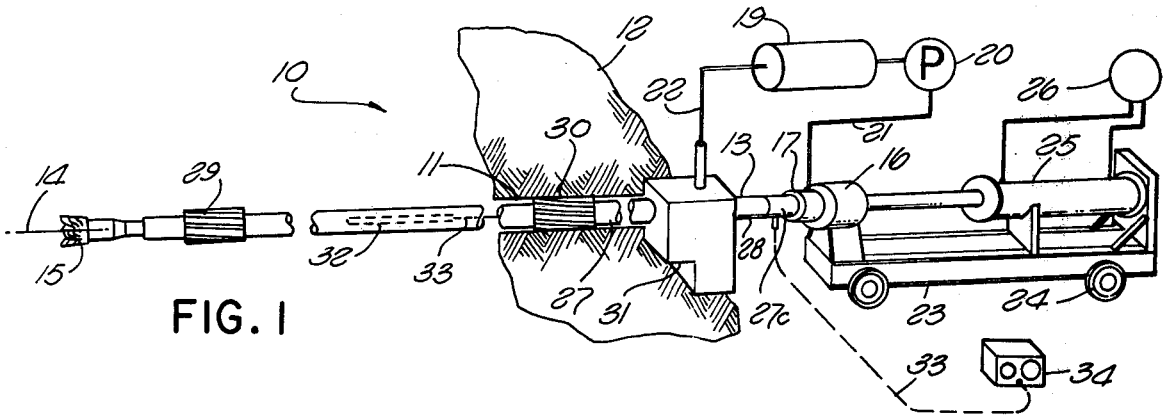
FIG. 1 is a fragmentary diagrammatic representation of horizontal earth drilling equipment constructed in accordance with the invention.
Figure 4:
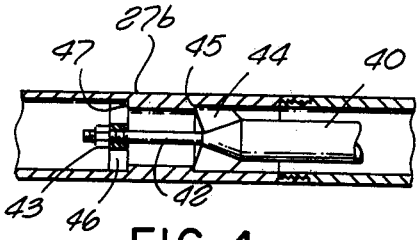
FIG. 4 is an enlarged fragmentary axial section taken on line 4—4 of FIG. 2.

In FIG. 1, there is represented somewhat diagrammatically at 10 a conventional rotary drilling unit of a type utilized for drilling a hole 11 horizontally into the earth as represented at 12. The drilling operation is effected by simultaneously rotating a tubular drill string 13 about its axis 14 and exerting inward pressure (leftwardly in FIG. 1) to cause a bit 15 at the end of the string to drill into the earth. The string is driven rotatively by a motor represented at 16, which turns a chuck 17 which grips and turns the outer end of the drill string. Circulating fluid is delivered into the drill string from a source 19 by a pump represented at 20, feeding the fluid into the end of the string through a line 21, with the fluid then flowing inwardly through the string to the bit and ultimately discharging at the bit location to carry the cuttings back to the right in FIG. 1 for ultimate return through a line diagrammatically represented at 22 to the source 19 at which the cuttings may settle out or be separated to permit recirculation of the fluid back into the string.

The motor 16 and chuck 17 may be mounted on a carriage 23, typically having wheels 24 engaging the surface of the earth or a truck structure, but which is fixed against movement as a power cylinder unit 25 mounted on the carriage exerts axial force leftwardly against motor 16 and chuck 17 and the connected drill string to drill into the earth. This power cylinder, which is hydraulically actuable by pressure fluid from a source represented at 26, may also exert reverse axial force in a rightward direction when desired.

The drill string 13 is formed in a conventional manner of a series of drill pipe sections 27 having threaded pin and box ends which are connectable together at 28 to form together the desired continuous tubular structure between chuck 17 and bit 15. Centralizers 29 and 30 may be provided for supporting the drill string on the bottom wall of the drilled hole at two spaced locations, to properly center the drill string in the hole, and if desired to induce a controlled curve in the hole by virtue of the tendency of the string to sag slightly at a location between the two centralizers, and thereby direct bit 15 slightly upwardly. Other conventional means may be employed for maintaining the drill string as straight as possible, or for inducing a slight change in direction of the hole at any particular location. At the surface of the earth, a stuffing box 31 is normally provided for sealing off the hole against leakage at that location.

For determining at any particular time the inclination of the portion of the bore hole 11 which is near bit 15, drill string 13 contains an instrument probe 32 which is connected by a flexible line 33 to read-out unit 34 located at the surface of the earth. This instrument assembly 32-33-34 may be of the general type disclosed in U.S. Pat. No. 3,791,043, preferably with the improved type of probe shown in U.S. Pat. No. 3,862,499. Alternatively, probe 32 may be any other type of instrument adapted to respond to one or more conditions in the well, and having an associated readout unit or other unit at the surface to which the instrument is connected by a flexible line. If probe 32 is of the type shown in U.S. Pat. No. 3,862,499, it contains three gravity actuated sensor elements 135 for responding to the inclination relative to axis 14 of three different mutually perpendicular axes fixed relative to the body of probe 32, to thus sense in effect three components of the probe inclination which together give enough information for unit 34 at the surface to determine the actual inclination of the probe. Further, the probe 32 may contain three magnetically responsive sensors 35, which determine the angularity relative to the earth's magnetic field of three mutually perpendicular axes fixed relative to the probe body. The sensors 35 thus determine in effect three components of the azimuth or direction in which the probe is inclined. A solid state electronic unit 36 within the probe, energized by a battery 37, receives the information from sensors 135 and 35, and delivers that information in multiplex form through flexible line 33 to unit 34 at the surface of the earth, at which the information is decoded to actuate two indicators 38 and 39 giving respectively the inclination of instrument 32 and the azimuth of that inclination. Line 33 may contain a single conductive wire insulated by an outer covering or layer of nylon or other flexible electrically insulative material.

The discussed sensors and other elements of instrument 32 are contained within an outer tubular housing 40 which is formed of a non-magnetic material, as is the pipe section **27*a* within which the instrument 32 is contained. The instrument is mounted centrally within pipe section 27*a*, to provide an annular space 41 through which the circulating fluid can flow downwardly past the instrument. At its inner end, the body 40 of probe 32 may be rigidly anchored to a sub 27*b* forming a section of the drill string, with the probe having a threaded rod 42 projecting therefrom and carrying a nut 43 which when tightened draws a number of radially spaced fins 44 on the probe against a first annular shoulder 45 in sub 27*b*, and draws a fluid passing spider 46 against a second annular shoulder 47 in sub 27*b*. At its right end, as viewed in FIGS. 1 and 2, the housing of probe 32 has a break away bolt 48 (FIG. 8) to which the flexible line 33 is connected and which has a frangible shank 49 weaker than the flexible line and weaker than the probe and its attachment to the drill string, so that when a pulling force of a predetermined magnitude is exerted on line 33 at the surface of the earth it will break the connection at 49 and allow the line to be pulled from the well while leaving probe 32 in the drill string. The element 48 and its shank 49 are of course designed to conduct electricity from the interior of probe 32 to line 33. The other side of the electrical circuit between the probe and unit 34** at the surface of the earth is completed through the metal of the drill string itself and/or through ground.

Figure 5:
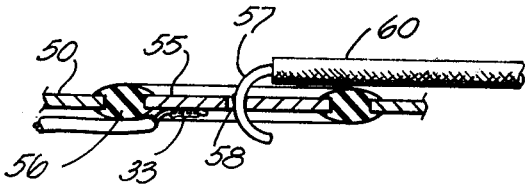
FIG. 5 is an enlarged section through the hook and eye connector members of FIG. 2.
Figures 2, 3, 3A:
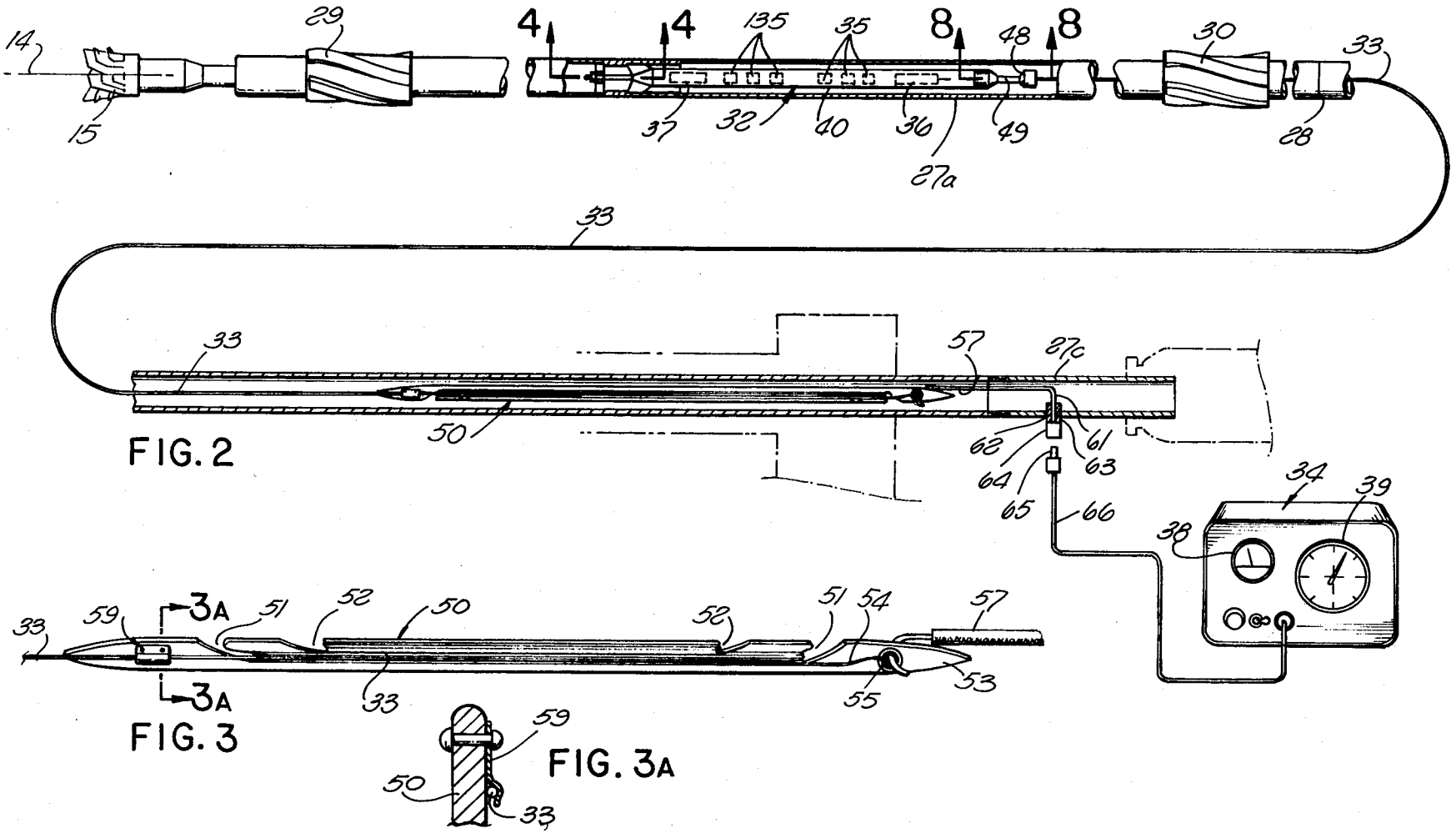
FIG. 2 is an enlarged fragmentary diagrammatic view illustrating certain portions of the FIG. 1 equipment in greater detail.
FIG. 3 is an enlarged perspective view showing the element about which the flexible conductive line is windable.
FIG. 3*a* is a fragmentary transverse section on line 3—3*a* of FIG. 3.

Contained within the drill string near the surface of the earth, there is provided an elongated element 50 (FIGS. 2 and 3), on which a portion of the flexible line or cable 33 is wound. As seen in FIG. 3, this element 50 may be formed of an elongated piece of flat sheet metal or other material, having two sets of notches 51 and 52 near the opposite preferably pointed ends 53 of the part 50, so that the flexible line can be wound within the notches 51 and 52 through many turns of a combined length corresponding to the amount of pipe which it is desired to add to drill string 13. The extremity 54 of the flexible line 33 is connected to a conductive ring 55 carried at an outer end of part 50, which ring is insulated by an insulative ring or grommet 56 (FIG. 5) from the main body of part 50. A conductive hook 57 rigidly secured to an outer end section **27*c* of the drill string 13 is adapted to extend through the opening 58 in the center of conductive ring 55, to form an electrical connection between the hook and ring 55, and through that ring with the end of the conductor in flexible line 33. At the opposite end of element 50, the cable after being wound about the element 50 through many turns may extend past and be releasably retained by an appropriate holding device, such as a spring clip 59 beneath which the line can be slipped and by which the line is then gripped and held tightly against element 50 in a manner preventing unwinding of the line from element 50. As seen in FIG. 5, the hook part 57 is preferably insulated as represented at 60** along its entire length except at the hook shaped extremity which actually contacts and forms an electrical connection with the conductive line.

Part 57 is rigid, as previously mentioned, and projects beyond the externally threaded end of section 27*c* for connection to part 50. Within part 27*c*, the member 57 curves laterally at 61, and extends through an opening at 62 in the side wall of part 27*c* with an insulated sleeve 63 preventing electrical contact of part 57 with pipe section 27*c*. At the outside of section 27*c*, conductor 57 carries an electrical connector 64, which is releasably attachable to a second electrical connector 65 leading through a flexible line 66 to the read-out unit 34. Connector 64 is desirably carried by part 27*c* closely adjacent its outer surface, and in fixed position relative thereto to avoid damage to part 64 when the drill string is rotated.

During a drilling operation, the outer end section 27*c* is driven rotatively about axis 14 and advanced leftwardly as viewed in FIG. 1, by drive unit 10 to correspondingly turn and advance the drill string in a manner causing bit 15 to drill a hole horizontally into the earth, with the cuttings being carried away by circulating fluid to the location 19. While the string is turning, elements 64 and 65 are disconnected. When it is desired to obtain readings giving the inclination of the portion of the hole containing instrument 32 and the azimuth of that inclination, the rotation of the drill string is halted, and parts 64 and 65 are connected together to complete the circuit between probe 32 and unit 34 through the flexible line 33. The gauges or other indicators 38 and 39 then give readings representing the inclination and its azimuth. When the drilling is subsequently resumed (after connectors 64 and 65 have been detached), attempts may be made to control the direction of drilling to compensate for any error which may have been discovered by the inclination reading, or to cause the drill string to follow any desired predetermined course. Readings may be taken in this manner at any appropriate intervals to give the drillers frequently updated information on the inclination of the hole.

Figure 6:
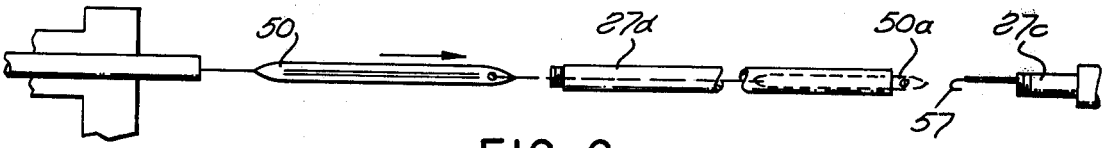
FIG. 6 is a side view similar to FIG. 1, but showing diagrammatically a step in the process of connecting an additional pipe section into the drill string.
Figure 7:
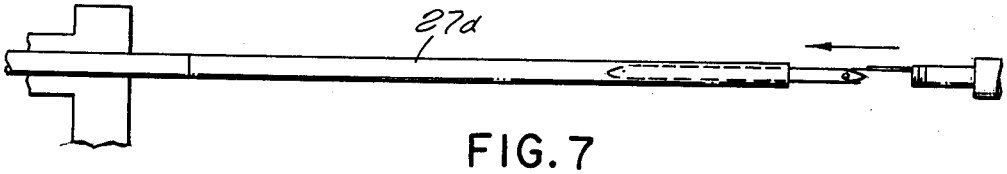
FIG. 7 is a view similar to FIGS. 1 and 6, but showing a next successive step in the process.

Each time that the drilling reaches a point at which the outer end section 27*c* of the drill string closely approaches the stuffing box 31 (as in FIG. 1), it then becomes necessary to insert another pipe section into the string at its outer end. As a first step in that lengthening procedure, section 27*c* is rotated relative to the rest of the string and in a back-off or unthreading direction, to detach 27*c* from the rest of the string as represented in FIG. 6. The element 50 and the portion of the flexible line wound thereon are pulled from the end of the drill string after section 27*c* has been removed, with such removal of the element 50 being permitted by at all times maintaining sufficient slack in the flexible line beyond element 50 to enable such removal. FIG. 6 shows element 50 withdrawn from the outer portion of the drill string. After element 50 has been thus withdrawn, it is detached from hook part 57, as again illustrated in FIG. 6, to thereby form a break in the electrical circuit to unit 34, enabling an extra pipe section 27*d* to be located between element 50 and part 27*c*. Some of the flexible line 33 on element 50 is then unwound from that element, in an amount corresponding to the length of the pipe section 27*d* which is to be inserted into the string, to thus increase the effective length of the flexible line in the amount corresponding to the length of section 27*d*. Element 50 and the effectively lengthened line 33 are then threaded through the added pipe section 27*d*, to and beyond the position represented at 50*a* in broken lines in FIG. 6, following which part 50 is attached to hook 57 to complete the mechanical and electrical connection between line 33 and part 27*c*. If necessary, the part 50 may be completely removed from the right end of section 27*d* in order to facilitate the attachment of part 50 to hook 57. After such attachment, part 50 may be re-inserted into the right end of part 27*d* into a position similar to that represented in broken lines in FIG. 6.

With the parts thus connected, section 27*d* can be moved leftwardly in FIG. 6 into engagement with the end of the pipe string and be threadedly connected to that pipe string, following which outer end section 27*c* can be threadedly connected to section 27*d* to complete the insertion of section 27*d* into the string. Unit 10 can then be again actuated to rotate and advance leftwardly the drill string to advance the drill further into the earth, and inclination readings ca be obtained whenever desired by attaching connector elements 64 and 65. In this way, any desired number of pipe sections may be added to the string, to drill whatever length of hole may be required, with the effective length of flexible line 33 being increased each time a section is added, and without the necessity for removing the flexible line or instrument 32 from the drill string.

Figure 8:
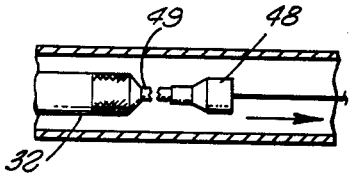
FIG. 8 is an enlarged section taken on line 8—8 of FIG. 2, and showing the manner in which the flexible line is ultimately broken away from the instrument probe in the string.

When it becomes necessary to remove the drill string for any reason, as for instance to replace bit 15, an operator may exert pulling force on line 33 from the surface of the earth, to break the frangible connection at 49 as represented in FIG. 8, and allow the line 33 to be removed from the string while leaving the probe 32 therein. The drill string is then removed sectionally from the drilled hole in conventional manner, and while the bit is being repaired or replaced the instrument 32 may be serviced or repaired, and its battery or batteries may be replaced if necessary. The string is then reinserted into the hole, with substantially all of the flexible line 33 initially being wound on element 50 but being gradually unwound therefrom each time that another pipe section is added to the string.

While a primary utility of the invention resides in the advantages attained when sections are added to the drill pipe and the length is increased, it is of course contemplated that a similar procedure may in some instances be employed in removing sections from the string, with a length of the line 33 being rewound on element 50 each time that a pipe section of the same length is removed, and with the hook 57 being detached from part 50 to enable such removal of each section laterally from the string.

To this point, it has been assumed that the drill string 13 is of a type which rigidly carries the bit and turns it by rotation of the string itself. It will also be apparent that the invention as described may be applied to an arrangement in which the drill string does not turn, but instead the bit assembly 15 is of the type including a motor at the bit location for power rotating the bit relative to the non-rotating drill string. In this event, the unit 10 functions only to exert axial force on the drill string, and does not rotate it. The motor of the bit assembly would then in most instances be driven by the pressure of the circulating fluid which is delivered to the drill string by pump 28.

Figure 9:
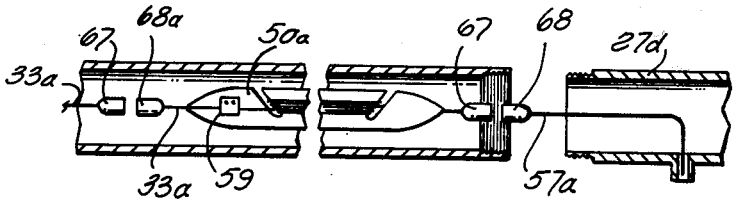
FIG. 9 is a view showing the manner of use of a second wire carrying element.

In very deep wells, it may be desirable to utilize more than one of the line carrying elements (such as element 50 of FIG. 3) in order to increase the total amount of line which can be lowered into the well. FIG. 9 illustrates the manner in which two or more such line carrying elements 50*a* can be connected into the system. Each of these elements 50*a* can be identical with the element 50 of FIG. 3 except that the upper end of the line 33*a* (corresponding to line 33 of the first form of the invention) is not permanently attached to the upper end of element 50*a*, but rather carries an electrical connector 67 which is separate from the part 50*a* and is detachably connectable to a mating connector 68 carried by part 57*a* (corresponding to conductor 57 of FIG. 2). This part 57*a* is in turn attached to a member 27*d* corresponding to part 27*c* of the first form of the invention. At the lower end of each line carrying element 50*a*, the line 33*a* carries a connector 68*a* which is identical with connector 68, so that it may be attached to a connector 67 of the next successive line 33*a*.

In FIG. 9, it may be assumed that the line 33*a* from a first element 50*a* has been completely unwound from that element, and that part 50*a* has been removed entirely from the well pipe, so that the second element 50*a* may be connected into the system between the first line 33*a* and upper connector 68. This result is achieved by merely attaching the lower connector 68*a* of the line 33*a* on the second element 50*a* to the upper end connector 67 of the previously installed line 33*a*, and then connecting the upper connector 67 of the line 33*a* on the second element 50*a* to connector 68 of the upper carrying part 27*d*, to complete the electrical circuit from the instrument in the well to the readout unit through both lines 33*a* in series. As additional pipe stands are connected into the string, the second line 33*a* may be progressively unwound from its carrying element 50*a*, until ultimately it is completely unwound and that second element 50*a* can be removed from the pipe to allow insertion of an additional element 50*a* and carried line, et cetera. As will be understood, the connectors 67, 68 and 68*a* are of a type forming both an electrical and mechanical connection, with the mechanical connection being of a type acting to transmit tensile forces through the connectors 67, 68 and 68*a* so that the connections will not become detached accidentally in use and until they may permanently be separated at a later time. Also, the strength of these connections once made is greater than the strength of the frangible connection at element 49, so that a pulling force can be exerted through a series of the interconnected lines 33*a* and will have to break the frangible connection 49 without opening the connections between elements 67 and 68 or 67 and 68*a*. The connectors 67 and 68, and connectors 67 and 68*a*, are of a sealed insulated type in which the conductors are enclosed within an outer layer of electrical insulating material acting when the connectors are joined to prevent electrical contact between the well pipe and the conductors in connectors 67, 68 or 68*a*.

While certain specific embodiments of the present invention have been disclosed as typical, the invention is of course not limited to these particular forms, but rather is applicable broadly to all such variations as fall within the scope of the appended claims.

We claim:

1. The method that comprises:

drilling a hole into the earth utilizing a tubular drill string which is formed of interconnected pipe sections and which contains an instrument, a flexible line extending from the instrument through the drill string to a unit at the surface of the earth, and an element within an outer portion of the drill string about which a portion of said flexible line is wound;

changing the length of the drill string by changing the number of pipe sections therein;

leaving in the drill string during such change in length said instrument and a part of said flexible line leading from the instrument toward the surface of the earth;

breaking the connection from said part of the flexible line to said unit while the length of the drill string is being changed;

changing the number of turns of said flexible line which are wound on said element when the length of the drill string is changed to correspondingly alter the effective length of the flexible line; and reconnecting said part of the flexible line in the drill string to said unit after the length of the drill string has been changed.

2. The method as recited in claim 1, in which said drill string has a section at the surface of the earth carrying a part detachably connectable to said element, said connection between said flexible line and said unit being broken by detaching said element from said part while the length of the drill string is being changed.

3. The method that comprises:

drilling a hole in the earth utilizing a tubular drill string including a series of interconnected pipe sections; with the string containing an instrument, a flexible line extending from the instrument to the surface of the earth and connecting to a unit at the surface of the earth, and an element near the surface of the earth on which a portion of said flexible line is wound; and with said drill string having an end section at the surface of the earth which is detachably connected to the remainder of the string;

increasing the length of the drill string by connection of an additional pipe section thereinto at the surface of the earth between said end section and the remainder of the string;

breaking the connection between said flexible line and said unit by detaching said element from said end section of the drill string before connection of said additional pipe section into the string; and, reconnecting said flexible line to said unit with the flexible line extending through said additional section.

4. The method that comprises:

drilling a hole in the earth utilizing a tubular drill string including a series of interconnected pipe sections; with the string containing an instrument, a flexible line extending from the instrument to the surface of the earth and connecting to a unit at the surface of the earth, and an elongated element near the surface of the earth on which a portion of said flexible line is wound; and with said string including an outer end portion having a part detachably connectable to said element and which is in turn connected to said unit;

detaching said outer end section of the drill string from the remainder of the drill string;

increasing the length of the drill string by connection of an additional pipe section thereinto at the surface of the earth;

breaking the connection between said flexible line and said unit by detaching said part from said element before connection of said additional pipe section into the string;

unwinding a portion of the flexible line from said element;

threading said element through said additional pipe section; and reconnecting said part to said element with said additional section between said outer end section and the remainder of the drill string.

5. The method as recited in claim 4, including rotating said drill string as the latter drills said hole; and disconnecting said part electrically from said unit to facilitate such rotation.

6. The method that comprises:

drilling a hole in the earth utilizing a tubular drill string including a series of interconnected pipe sections, with the string containing an instrument and a flexible line extending from the instrument to the surface of the earth and connecting to a unit at the surface of the earth;

increasing the length of the drill string by connection of an additional pipe section thereinto at the surface of the earth;

breaking the connection between said flexible line and said unit before connection of said additional pipe section into the string;

reconnecting said flexible line to said unit with the flexible line extending through said additional section;

ultimately removing said flexible line from the drill string separately from said instrument; and then sectionally removing the drill string and contained instrument from the hole.

7. The method that comprises:

drilling a hole in the earth utilizing a tubular drill string including a series of interconnected pipe sections; with the string containing an instrument, a flexible line extending from the instrument to the surface of the earth and connecting to a unit at the surface of the earth, and an element near the surface of the earth about which a portion of said flexible line is wound; and with said string having an outer end section containing a hook part detachably connectable to said element and electrically connectable to said flexible line; and with said outer end section having a side wall carrying a connector detachably connectable to said unit;

increasing the length of the drill string by connection of an additional pipe section thereinto at the surface of the earth between said end section and the remainder of the string;

breaking the connection between said flexible line and said unit by disconnecting said part from said element about which the flexible line is wound before connection of said additional pipe section into the string;

threading said element and said flexible line at least partially through said additional section;

rotating the drill string as the hole is drilled;

intermittently stopping said ratation; and attaching said unit electrically to said part through said connector while the rotation has stopped to take a reading from said unit.

8. Apparatus comprising:

a drill string including a series of interconnected pipe sections;

an instrument contained in said string;

a flexible conductive line extending from said instrument to the surface of the earth;

a unit at the surface of the earth electrically connected to said flexible line; and electrical connector members at the surface of the earth through which said flexible line is connected to said unit and which are detachable in a relation enabling an additional pipe section to be connected into the drill string and enabling said flexible line to be connected to the unit through said additional section by reattachment of said connector members;

one of said connector members being an electrically conductive hook element and the other of said connector members beig a part having an opening through which said hook extends.

9. Apparatus comprising:

a drill string including a series of interconnected pipe sections;

an instrument contained in said string;

a flexible conductive line extending from said instrument to the surface of the earth;

a unit at the surface of the earth electrically connected to said flexible line;

electrical connector members at the surface of the earth through which said flexible line is connected to said unit and which are detachable in a relation enabling an additional pipe section to be connected into the drill string and enabling said flexible line to be connected to the unit through said additional section by reattachment of said connector members; and an elongated element in the drill string and about which a portion of said flexible line is wound and from which the line can be unwound to increase the effective length of the flexible line when said additional section is added to the drill string;

said string including an outer end section carrying one of said connector parts, the other of said connector parts being carried by an end of said element.

10. Apparatus comprising:

a drill string including a series of interconnected pipe sections;

an instrument contained in said string;

a flexible conductive line extending from said instrument to the surface of the earth;

a unit at the surface of the earth electrically connected to said flexible line;

electrical connector members at the surface of the earth through which said flexible line is connected to an unit and which are detachable in a relation enabling said additional pipe section to be connected into the drill string and enabling said flexible line to be connected to the unit through said additional section by reattachment of said connector members; and an element in the drill string on which a portion of said flexible line is wound and from which the flexible line can be unwound upon connection of said additional pipe section into the string;

said element having an electrically conductive eye opening forming one of said connector parts;

said drill string including an outer end section connected to said unit;

the other of said connector parts being a conductive hook carried by said outer end section of the drill string and detachably connectable in conductive relation into said eye opening of said element.

11. Apparatus as recited in claim 10, including a conductor extending through a side wall of said outer end section of the drill string and connected to said unit.

12. Apparatus as recited in claim 10, including a conductor extending through a side wall of said outer end section of the drill string, and two additional electrical connector members detachably connecting said conductor to said unit.

13. Apparatus as recited in claim 12, including a frangible connection in the string between said instrument and said flexible line for enabling the flexible line to be withdrawn from the drill string separately from the instrument.

14. Apparatus as recited in claim 13, including means for rotating the drill string to drill said hole.

15. The method that comprises:

drilling a hole in the earth utilizing a tubular drill string including a series of interconnected pipe sections, with an instrument contained in the string and a flexible conductor line extending therefrom to the surface of the earth for connection to a unit at the surface;

winding a portion of said flexible line on an element and positioning said element in the string;

connecting an additional pipe section into said string;

unwinding part of the flexible line from said element when said additional section is connected into the string, to correspondingly increase the effective length of the flexible line;

successively connecting into the drill string more additional pipe sections;

progressively unwinding said flexible line from said element as the sections are added until the line is completely unwound from the element;

connecting in series with said flexible line an additional flexible conductor line which is wound upon a second element;

drilling said hole further into the earth while said second element and said additional line thereon are within the string;

connecting further pipe sections successively onto the string; and progressively unwinding said additional flexible line from said second element as said further pipe sections are connected into the string.

16. Apparatus comprising:

a tubular drill string for drilling a hole in the earth;

an instrument carried in the drill string;

a flexible conductive line extending from the instrument and through the drill string to the surface of the earth and connected electrically to a unit at the surface;

an element in the drill string on which a portion of said flexible line is wound and from which it can be unwound to increase the effective length of the flexible line when the drill string is lengthened;

a second flexible conductive line adapted to be connected in series with said first mentioned flexible conductive line after the latter has been unwound from said element; and a second element on which said second flexible line is wound and adapted to be placed in the drill string with said second line thereon and from which said second line can be progressively unwound to increase the effective length of the second line when the drill string is lengthened.

17. The method that comprises:

drilling a hole into the earth utilizing a tubular drill string which is formed of interconnected pipe sections and which contains an instrument, a flexible line extending from the instrument through the drill string to a unit at the surface of the earth, and an element within an outer portion of the drill string about which a portion of said flexible line is wound;

changing the length of the drill string by changing the number of pipe sections therein;

leaving in the drill string during such change in length said instrument and at least a part of said flexible line leading from the instrument toward the surface of the earth; and changing the number of turns of said flexible line which are wound on said element when the length of the drill string is changed to correspondingly alter the effective length of the flexible line.

18. The method that comprises:

drilling a hole in the earth utilizing a tubular drill string including a series of interconnected pipe sections, with the string containing an instrument, a flexible line extending from the instrument to the surface of the earth and connecting to a unit at the surface of the earth, and an element in the string about which a portion of said flexible line is wound;

increasing the length of the drill string by connection of an additional pipe section thereinto at the surface of the earth;

breaking the connection between said flexible line and said unit before connection of said additional pipe section into the string;

reconnecting said flexible line to said unit with the flexible line extending through said additional section; and decreasing the number of turns of the flexible line on said element to increase the effective length of the flexible line when said additional section is connected into the drill string.

19. The method as recited in claim 18, including rotating said drill string during drilling of the hole, and disconnecting said flexible line from said unit to facilitate said rotation.

20. The method that comprises:

drilling a hole in the earth utilizing a tubular drill string including a series of interconnected pipe sections, with an instrument contained in the string and a flexible conductor line extending therefrom to the surface of the earth for connection to a unit at the surface;

winding a portion of said flexible line on an element and positioning said element in the string;

connecting an additional pipe section into said string; and decreasing the number of turns of the flexible line on said element when said additional section is connected into the string, to correspondingly increase the effective length of the flexible line.

21. Apparatus comprising:

a drill string including a series of interconnected pipe sections;

an instrument contained in said string;

a flexible conductive line extending from said instrument to the surface of the earth;

a unit at the surface of the earth electrically connected to said flexible line;

electrical connector members at the surface of the earth through which said flexible line is connected to said unit and which are detachable in a relation enabling additional pipe sections to be connected into the drill string and enabling said flexible line to be connected to the unit through said additional sections by reattachment of said connector members; and an element in the drill string about which a plurality of turns of said flexible line are wound, and from which said turns can be unwound successively to decrease the number of turns on said element and thereby increase the effective length of the flexible line when said additional sections are added to the drill string.

22. Apparatus as recited in claim 21, in which said element about which the flexible line is wound is connectable to said unit through said connector members.

23. Apparatus comprising:

a tubular drill string for drilling a hole in the earth and adapted to be changed in length;

an instrument carried in the drill string;

a flexible conductive line extending from the instrument and through the drill string to the surface of the earth and connected electrically to a unit at the surface; and an element in the drill string about which a plurality of turns of said flexible line are wound in a relation enabling the different turns of the line to be successively wound onto or unwound from the element, to thereby change the number of turns on said element and thus alter the effective length of the flexible line when the length of the drill string is changed.

24. Apparatus comprising:

a tubular drill string formed of a series of interconnected pipe sections;

an instrument contained in the drill string;

a flexible line extending from the instrument and within the drill string toward the surface of the earth;

an element in the drill string about which a plurality of turns of said flexible line are wound and from which said different turns can be unwound successively, to decrease the number of turns on said element and thereby increase the effective length of the flexible line when the length of the drill string is changed;

a conductor extending through a side wall of a section of the drill string at the surface of the earth; and a unit at the surface of the earth connected to the flexible line through said conductor.

25. Apparatus as recited in claim 24, including two electrical connector members attaching said conductor electrically to said unit.

* * * * *